US008864098B2

(12) United States Patent
Bottazzi

(10) Patent No.: US 8,864,098 B2
(45) Date of Patent: Oct. 21, 2014

(54) PLATE CARRIER FOR PLATE FIXING DEVICE

(75) Inventor: Marc Bottazzi, Saint Vincent de Boisset (FR)

(73) Assignee: m.b.H Developpement, Saint Romain La Motte (FR)

( * ) Notice: Subject to any disclaimer, the term of this patent is extended or adjusted under 35 U.S.C. 154(b) by 187 days.

(21) Appl. No.: 13/437,334

(22) Filed: Apr. 2, 2012

(65) Prior Publication Data

US 2013/0075559 A1 Mar. 28, 2013

(30) Foreign Application Priority Data

Sep. 23, 2011 (FR) ..... 11 58484

(51) Int. Cl.
*A47G 29/00* (2006.01)
*F16M 11/00* (2006.01)
*E04F 21/18* (2006.01)

(52) U.S. Cl.
CPC ..... *E04F 21/1805* (2013.01); *E04F 21/1811* (2013.01)
USPC ..... 248/688; 248/122.1; 248/125.8; 248/176.1; 248/284.1; 248/276.1; 248/299.1; 248/354.5

(58) Field of Classification Search
CPC ..... E04F 21/1805; E04F 21/1811
USPC ..... 248/688, 447, 448, 449, 460, 461, 462, 248/122.1, 125.8, 159, 176.1, 284.1, 276.1, 248/299.1, 354.5
See application file for complete search history.

(56) References Cited

U.S. PATENT DOCUMENTS

| | | | | | |
|---|---|---|---|---|---|
| 1,184,246 | A * | 5/1916 | Klein | 248/448 |
| 1,576,154 | A * | 3/1926 | Steinman | 248/448 |
| 2,912,203 | A * | 11/1959 | Townsend | 248/448 |
| 3,231,230 | A * | 1/1966 | Mueller | 248/449 |
| 4,285,532 | A * | 8/1981 | Davis | 281/42 |
| 4,793,083 | A * | 12/1988 | McDonald | 40/606.13 |
| 4,856,749 | A * | 8/1989 | Habermann | 248/448 |
| 5,121,890 | A * | 6/1992 | Komada | 248/122.1 |
| 5,366,197 | A * | 11/1994 | Westland | 248/456 |
| 5,467,958 | A * | 11/1995 | Selvaggio | 248/449 |
| 5,725,192 | A * | 3/1998 | Cloninger | 248/458 |
| 5,979,854 | A * | 11/1999 | Lundgren et al. | 248/354.3 |
| 6,176,063 | B1 * | 1/2001 | Warin | 52/749.1 |
| 6,601,805 | B1 * | 8/2003 | Kapp | 248/171 |
| 7,530,543 | B1 * | 5/2009 | Kremzar | 248/441.1 |
| 8,157,306 | B1 * | 4/2012 | Guerin | 294/209 |
| 8,162,281 | B2 * | 4/2012 | Logue | 248/447 |

(Continued)

FOREIGN PATENT DOCUMENTS

| | | |
|---|---|---|
| EP | 0777021 A1 | 6/1997 |
| EP | 0856621 A1 | 8/1998 |

*Primary Examiner* — Terrell McKinnon
*Assistant Examiner* — Michael McDuffie
(74) *Attorney, Agent, or Firm* — Heslin Rothenberg Farley & Mesiti P.C.

(57) ABSTRACT

A plate carrier for mounting at the upper end of the upper element of a central pole of a plate hoist device includes at least one longitudinal central body formed by two substantially rectangular plates separated by three longitudinal walls forming two central sheaths and two peripheral grooves. Each central sheath accommodates a generally T-shaped transverse arm which includes a longitudinal median branch slidably mounted in a sheath and a transverse tubular part welded to a free end of the median branch. The transverse tubular part extending substantially in a plane of the central body.

7 Claims, 3 Drawing Sheets

(56) References Cited

U.S. PATENT DOCUMENTS 8,464,988 B1 * 6/2013 Walker ..... 248/122.1
8,520,371 B2 * 8/2013 Peng et al. ..... 361/679.01
2010/0320354 A1 * 12/2010 Prost ..... 248/448

* cited by examiner

PLATE CARRIER FOR PLATE FIXING DEVICE

CROSS REFERENCE TO RELATED APPLICATIONS

This application claims priority of French application no. 1158484 filed on Sep. 23, 2011, the entire contents of which is hereby incorporated herein.

FIELD OF THE INVENTION

This invention relates to a plate or board carrier for a device used for fixing plates or boards made of any materials, such as plasterboards for example, in order to form false ceilings or furnish under a roof pitch and on partitions.

BACKGROUND TO THE INVENTION

To make it easier to fit ceiling boards or furnish under roof pitches, use is commonly made of manual devices known as "plate-hoists", these including, as shown in FIG. 1, a stand (1) consisting of three foldaway feet (1*a*, 1*b*, 1*c*) the ends of which are provided to advantage with casters (2), a central telescopic pole (3) made up of two or more elements, which is extended by means of a manual winch (4) activated by a flywheel (5) and at least one cable (6) activated by said winch (4), and a plate carrier (7) mounted at the upper end of the upper element of the central pole (3), said plate carrier (7) being able to advantage to be slanted relative to the horizontal.

Said plate carrier (6) commonly consists of a horizontal central bar (8) and two transverse arms (9) extending crosswise to the ends of said central bar (8) so that the plate carrier (7) is generally H-shaped. Each transverse arm (9) comprises at one of the free ends thereof a hook (10) on which the edge of a plate is able to be supported. Said hooks (10) are to advantage free rotatably mounted so that they can be removed when the plate is fitted against the ceiling for example.

Furthermore, the plate carrier (7) comprises two T-shaped longitudinal arms (11), each longitudinal arm (11) comprising a median branch (12) slidably mounted at one of the ends of the central bar (8) and a tubular part (13) extending crosswise to the median branch (12), said tubular part (13) being to advantage provided with rubber pads (14) or the like in order to prevent the plate from slipping when it is positioned on the plate carrier (7).

This type of "plate hoist" device, and the "plate hoists" described in European patent applications EP 0777021 and EP 0856621, can be used to lift ceiling boards to the required height and to keep said boards at a height in order to facilitate the fitting thereof. The swivel mounting of the plate carrier at the upper end of the pole facilitates the initial placing of each ceiling board on the device and the installation of each hoisted plate or board, either in a horizontal position, to form an ordinary ceiling, or in a slanted position, for a so-called "under roof pitch" fitting.

The plate carriers of these "plate hoist" devices are not suitable for fitting vertical plates, to form partitions or walls.

Furthermore, prior art "plate hoist" devices can generally be dismantled in order to reduce their space requirement when they are not in use. The pole may thus be separated from the stand which can generally be folded away and the plate carrier may be separated from the upper end of the pole.

However, prior art plate carriers have the drawback of being bulky even after they are dismantled.

DISCLOSURE OF THE INVENTION

One of the purposes of the invention is therefore to overcome these drawbacks by proposing a plate carrier of straightforward and inexpensive design, suitable for being secured to any type of "plate hoist" device, that has a small space requirement after use and allows plates to be fitted both horizontally, in order to form ceilings, and at a slant for a so-called "under roof pitch" fitting or vertically to form partitions or walls.

To this end, and in accordance with the invention, a plate carrier (7) is proposed for mounting at the upper end of the upper element of the central pole of a "plate hoist" device or the like; said plate carrier is remarkable in that it comprises at least one longitudinal central body consisting of two substantially rectangular plates separated by three longitudinal walls forming two central sheaths and two peripheral grooves, each central sheath accommodating a generally T-shaped transverse arm which includes a longitudinal median branch slidably mounted in a sheath and a transverse tubular part welded to the free end of the median branch, said transverse tubular part extending substantially in the plane of the central body.

It will be understood that, unlike prior art plate carriers, the inventive plate carrier allows all the elements to be folded away in the central sheaths and the peripheral grooves in order to reduce the space required thereby.

Preferably, each median branch comprises a finger engaging with a spring and capable of being inserted in apertures provided along the median branch in order to adjust the length of the longitudinal median branch of the transverse arms projecting from the sheaths as a function of the dimensions of the plate to be carried.

To allow vertical plates to be fitted, at least one of the transverse tubular parts of the transverse arms comprises stops extending orthogonally relative to said transverse tubular parts and to the median branches.

Preferably, these stops are positioned symmetrically on either side of the longitudinal median branch, in proximity to the free ends of the transverse tubular part.

Advantageously, the plate carrier of the invention comprises two transverse arms articulated respectively around an axis rigidly connected to the free ends of the central body in the peripheral groove and two transverse arms articulated respectively around an axis rigidly connected to the free ends of the central body in the opposite peripheral groove.

Furthermore, the plates project from the peripheral grooves, at the free ends of the central body, to form flanges in which curvilinear apertures are provided which form cam tracks wherein cam-forming lugs rigidly connected to the arms are able to move so that said arms are able to move from a foldaway position wherein the arms extend in the peripheral grooves to an unfolded position respectively wherein said arms extend orthogonally to the central body.

BRIEF DESCRIPTION OF THE FIGURES

Other advantages and characteristics will become clearer from the following description of a single embodiment alternative, given as a non-restrictive example, of the inventive plate carrier, with reference to the appended drawings wherein.

DETAILED DESCRIPTION OF THE INVENTION

In the interests of clarity, in the remainder of the description, the same elements have been referred to using the same reference numbers in the various figures. Moreover, the various cross-section views are not drawn to scale.

Figure 1:
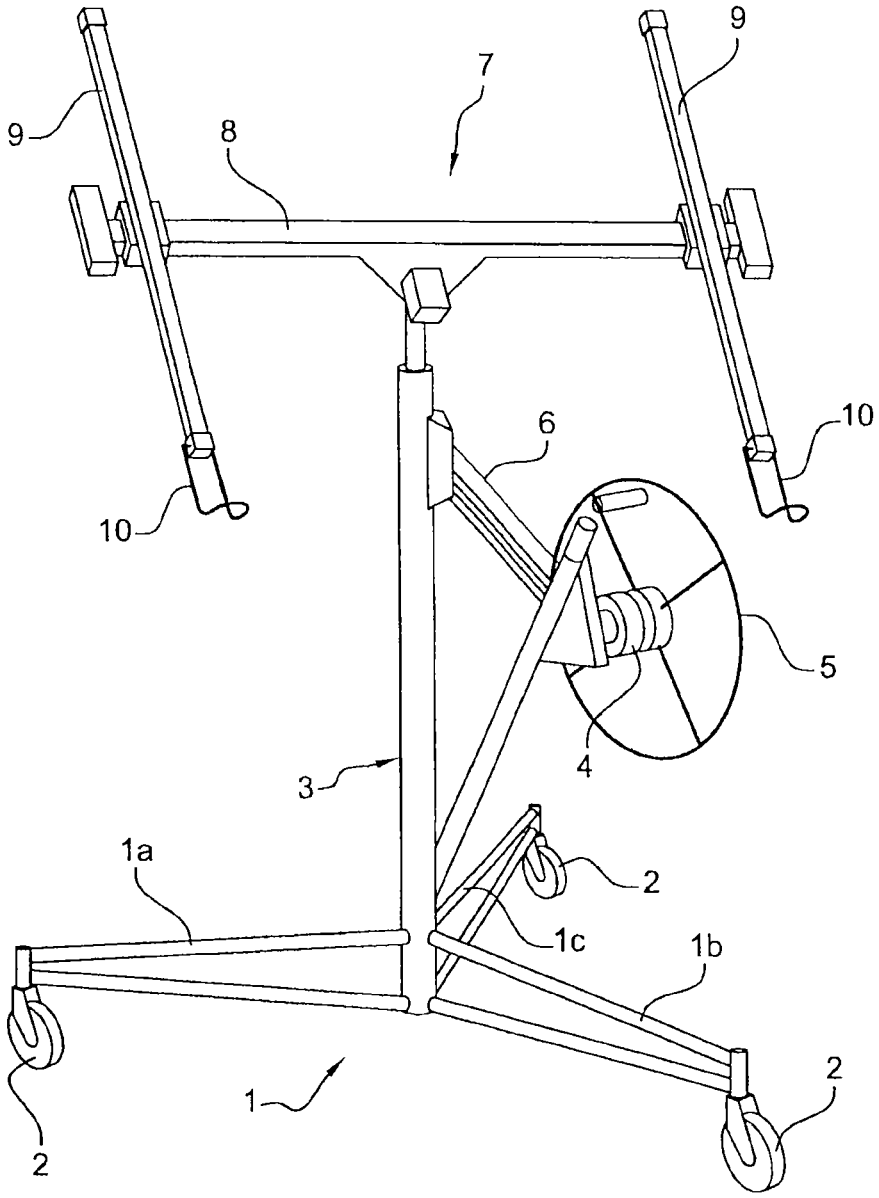
Fig. 1 Prior Art
FIG. 1 is a perspective view of a "plate hoist" device comprising a plate carrier according to the prior art.
Figures 2, 3:
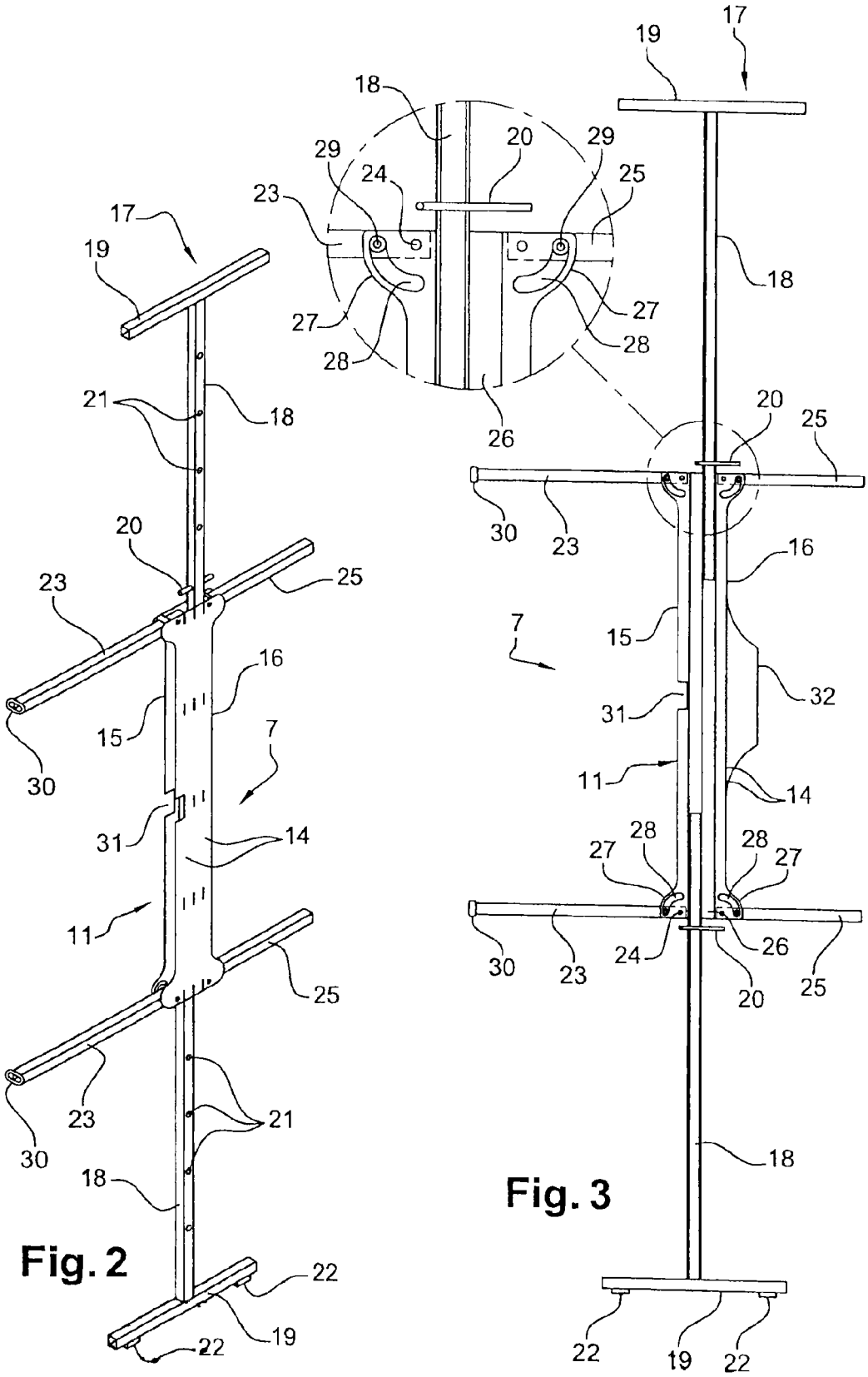
FIG. 2 is a perspective view of the inventive plate carrier in the unfolded position.
FIG. 3 is a view from above of the inventive plate carrier in the unfolded position.
Figure 4:
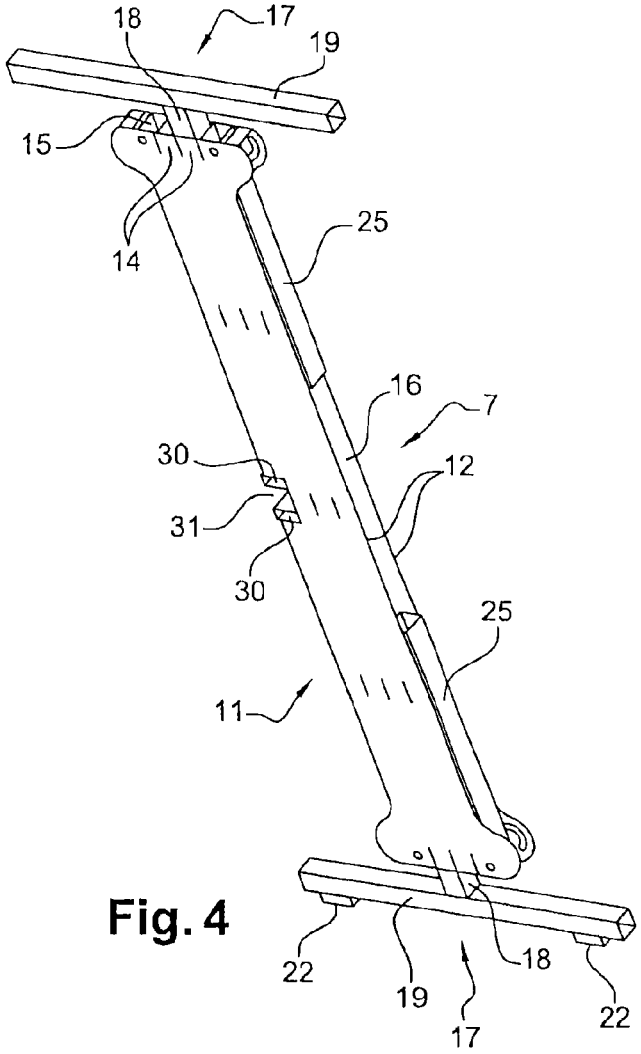
FIG. 4 is a perspective view of the inventive plate carrier in the foldaway position.
Figure 6:
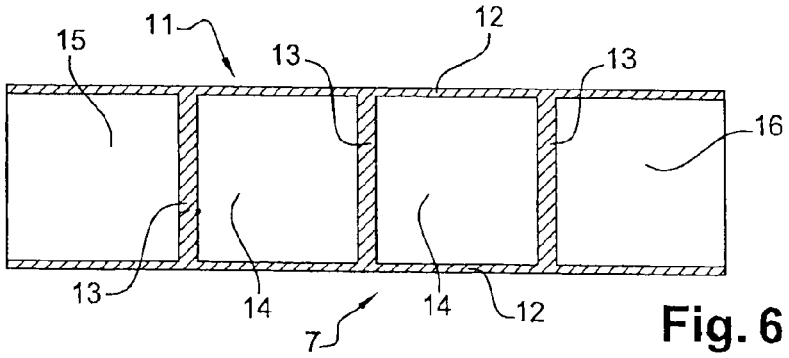
FIG. 6 is a transverse cross-section view of the central body of the plate carrier shown in FIG. 3.

With reference to FIGS. 2, 3 and 6, the plate carrier (7) of the invention comprises a longitudinal central body (11) consisting of two substantially rectangular plates (12) separated by three longitudinal walls (13) forming two central sheaths (14) and two peripheral grooves (15) and (16).

The central sheaths (14) accommodate respectively a generally T-shaped transverse arm (17) including a longitudinal median branch (18) slidably mounted in a sheath (14) and a transverse tubular part (19) welded to the free end of the median branch (18), said transverse tubular part (19) extending substantially in the plane of the central body (11).

In order to adjust the length of the longitudinal median branch (18) of the transverse arms projecting from the sheaths (14), as a function of the dimensions of the plate to be carried, each median branch (18) comprises a finger (20) engaging with a spring and capable of being inserted into apertures (21) provided along the median branch (18).

With reference to FIGS. 2, 3, 4 and 5, at least one of the transverse tubular parts (19) of the transverse arms comprises stops (22) extending orthogonally relative to said transverse tubular parts (19) and to the median branches (18). These stops (22) are positioned symmetrically on either side of the longitudinal median branch (18), in proximity to the free ends of the transverse tubular part (19) and are intended to accommodate the edge of a plate to be fitted vertically, the plate carrier (7) then being orientated vertically on the "plate hoist" device not shown in the figures.

Furthermore, with reference to FIGS. 2 and 3, the plate carrier (7) of the invention comprises two articulated transverse arms, two arms (23) respectively articulated around an axis (24) rigidly connected to the free ends of the central body (11) in the peripheral groove (16) and two arms (25) respectively articulated around an axis (26) rigidly connected to the free ends of the central body (11) in the opposite peripheral groove (15).

The plates (12) project from the peripheral grooves (15) and (16), at the free ends of the central body (11), to form flanges (27) wherein curvilinear apertures (28) are provided. These curvilinear apertures (28) form cam tracks wherein cam-forming lugs (29), rigidly connected to the arms (23) and (25), are able to move so that said arms are able to move from a foldaway position (FIGS. 4 and 5) wherein the arms (23) and (25) extend in the peripheral grooves (15) and (16) respectively to an unfolded position wherein said arms (23) and (25) extend orthogonally to the central body (11).

A first pair of arms (25) is shorter in length than half the length of the central body (11). The other pair of arms (23) is substantially equal in length to half the length of said central body (11) and, each arm (23) comprises at the free end thereof a stop (30) extending orthogonally to the arms (23) and to the plates (12) forming the central body (11).

To allow the arms (23) to be folded away in the peripheral groove (15), the edges of the plates (12) comprise in the median part thereof a substantially rectangular cutout (31), substantially matching the depth of the peripheral groove (15), said cutout (31) allowing the stops (30) projecting from the free ends of the arms (23) to pass when said arms are folded away in said peripheral groove (15).

It will be noted that these stops (30) are intended to accommodate the edge of a plate to be fitted horizontally or at a slant, the plate carrier (7) then being orientated horizontally or at a slant on the "plate hoist" device not shown in the figures.

Furthermore, it will be seen that, when the arms (23) and (25) are folded away in the peripheral grooves (15) and (16) respectively and the transverse arms folded away in their sheaths (14), the plate carrier (7) of the invention takes up a minimum amount of space making it easier to store and/or transport.

Figure 5:
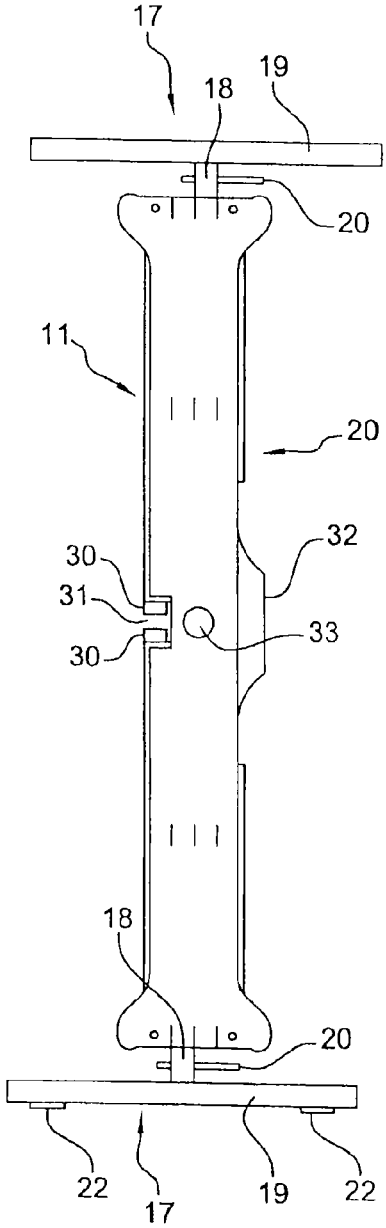
FIG. 5 is a view from above of the inventive plate carrier in the foldaway position.

Incidentally, with reference to FIGS. 3 and 5, the plate carrier of the invention comprises a handle (32) extending in the median part of the central body (11) from one of the longitudinal edges of at least one of the plates (12). This handle (32) can be used for easy transportation of the plate carrier since it provides good mass balance.

Furthermore, the plate carrier of the invention comprises means for securing the central body (11) to the upper end of the upper element of the central telescopic pole. In this particular embodiment example, said securement means comprise a cylindrical sleeve (33) extending in the central part of one of the plates (12) forming the central body (11), said sleeve extending orthogonally to said plate (12), and into which the upper end of the upper element of the telescopic central pole of a stand, not shown in the figures, is able to be slipped.

It will be seen that the securement means and/or the upper end of the upper element of the telescopic pole may include means capable of providing an adjustable tilt of the plate carrier without however departing from the framework of the invention.

Moreover, it will be noted that the plate carrier of the invention may be mounted on any type of "plate hoist" device without departing from the framework of the invention.

Lastly, it is quite obvious that the examples that have just been given are only particular illustrations, and are in no way restrictive in terms of the fields in which the invention may be applied.

The invention claimed is:

1. A plate carrier for mounting at an upper end of an upper element of a central pole of a plate hoist device, comprising at least one longitudinal central body formed by two substantially rectangular plates separated by three longitudinal walls forming two central sheaths and two peripheral grooves, each central sheath accommodating a generally T-shaped transverse arm which includes a longitudinal median branch slidably mounted in the sheath and a transverse tubular part welded to a free end of the median branch, said transverse tubular part extending substantially in a plane of the central body and further comprising first two transverse arms articulated respectively around an axis rigidly connected to free ends of the central body in a first peripheral groove and second two transverse arms articulated respectively around an axis rigidly connected to the free ends of the central body in an opposite second peripheral groove, wherein each first arm comprises at a free end thereof, a stop extending orthogonally to the first arms and to the plates forming the central body, and wherein edges of the rectangular plates comprise in a median part thereof a substantially rectangular cutout, substantially matching a depth of the first peripheral groove, said cutout allowing stops which project from the free ends of the second arms to pass when said arms are folded away in said first peripheral groove.

2. Plate carrier as claimed in claim 1 wherein each median branch comprises a finger engaging with a spring and adapted to be inserted into apertures provided along the median branch in order to adjust the length of the longitudinal median branch of the transverse arms projecting from the sheaths as a function of dimensions of a plate to be carried.

3. Plate carrier as claimed in claim 1 wherein at least one of the transverse tubular parts of the transverse arms comprises stops extending orthogonally relative to said transverse tubular parts and to the median branches.

4. Plate carrier as claimed in claim 3 wherein said stops are positioned symmetrically on either side of the longitudinal median branch, in proximity to the free ends of the transverse tubular part.

5. Plate carrier as claimed in claim 1 wherein the rectangular plates project from the first and the second peripheral grooves, in the free ends of the central body, to form flanges having curvilinear apertures which form cam tracks wherein cam-forming lugs, rigidly connected to the first two transverse arms and the second two transverse arms are able to move so that said first and second transverse arms move from a foldaway position wherein the first and second transverse arms extend in the first and second peripheral grooves, respectively to an unfolded position wherein said first and second arms extend orthogonally to the central body.

6. Plate carrier as claimed in claim 1 wherein the second pair of arms is shorter in length than half a length of the central body.

7. Plate carrier as claimed in claim 1 wherein the first pair of arms is substantially equal in length to half a length of the central body.

* * * * *

UNITED STATES PATENT AND TRADEMARK OFFICE

CERTIFICATE OF CORRECTION

PATENT NO. : 8,864,098 B2
APPLICATION NO. : 13/437334
DATED : October 21, 2014
INVENTOR(S) : Marc Bottazzi It is certified that error appears in the above-identified patent and that said Letters Patent is hereby corrected as shown below:

On the title page in the Assignee item (73): Delete "m.b.H Developpement" and insert --M.B.H. Developpement--

Signed and Sealed this
Third Day of February, 2015

Michelle K. Lee

Michelle K. Lee
*Deputy Director of the United States Patent and Trademark Office*